US009693596B2

(12) United States Patent
Huffman

(10) Patent No.: US 9,693,596 B2
(45) Date of Patent: Jul. 4, 2017

(54) FACE ARMOR

(71) Applicant: PDT Tech, LLC, Alamo, CA (US)

(72) Inventor: Rick Huffman, Redwood Valley, CA (US)

( * ) Notice: Subject to any disclaimer, the term of this patent is extended or adjusted under 35 U.S.C. 154(b) by 333 days.

(21) Appl. No.: 14/154,069

(22) Filed: Jan. 13, 2014

(65) Prior Publication Data

US 2014/0196199 A1 Jul. 17, 2014

Related U.S. Application Data

(60) Provisional application No. 61/752,367, filed on Jan. 14, 2013.

(51) Int. Cl.
*A42B 3/20* (2006.01)

(52) U.S. Cl.
CPC ..... *A42B 3/20* (2013.01)

(58) Field of Classification Search
CPC .... A42B 3/18; A42B 3/20; A42B 3/22; A42B 3/225; A63B 71/10
See application file for complete search history.

(56) References Cited

U.S. PATENT DOCUMENTS 2,525,389 A * 10/1950 Zeller ..... A42B 3/20 2/9
2,881,442 A 4/1959 Sowle
4,707,863 A 11/1987 McNeal
6,381,749 B1 5/2002 Cyr
6,957,447 B1 * 10/2005 Broersma ..... A42B 3/20 2/423
2004/0040073 A1 * 3/2004 Morrow ..... A42B 3/08 2/424
2004/0049825 A1 * 3/2004 DeHaan ..... F41H 1/04 2/6.7
2004/0111779 A1 * 6/2004 Gagnon ..... A42B 3/20 2/9
2006/0085882 A1 4/2006 Broersma
2007/0050895 A1 * 3/2007 Broersma ..... A61F 9/029 2/426
2007/0192946 A1 8/2007 Wright
2008/0086795 A1 4/2008 Cyr
(Continued)

FOREIGN PATENT DOCUMENTS

WO PCT/US14/11346 5/2014

*Primary Examiner* — Shaun R Hurley
*Assistant Examiner* — Andrew W Sutton
(74) *Attorney, Agent, or Firm* — Brian Beverly; Beeson Skinner Beverly, LLP

(57) ABSTRACT

Face armor according to the invention comprises a face guard having dual side panels for disposition on opposite sides of the head of a person wearing the face armor, wherein a side slit extends upwardly from the bottom edge of each side panel such that the chin strap of a helmet extending to the chin of a person wearing the helmet extends over a portion of the side panel rearward of the side slit, passes through the side slit, and extends under a portion of the side panel forward of the side slit, thereby minimizing interference from the face guard to a snug and comfortable fitting of the helmet's tightened chin strap along the side of the person's head. In one embodiment fasteners close over each side slit and a portion of the chin strap to secure the forward and rearward portions of the side panel together.

11 Claims, 10 Drawing Sheets

(56) References Cited

U.S. PATENT DOCUMENTS

| | | | | |
|---|---|---|---|---|
| 2011/0061152 | A1* | 3/2011 | Wismann | A42B 3/20 2/424 |
| 2011/0138520 | A1* | 6/2011 | DeBoer | A42B 3/20 2/425 |
| 2014/0196199 | A1* | 7/2014 | Huffman | A42B 3/20 2/421 |

* cited by examiner

FACE ARMOR

CROSS-REFERENCE TO RELATED APPLICATIONS

This application claims the benefit of U.S. Provisional Application No. 61/752,367 filed Jan. 14, 2013.

BACKGROUND

Field of the Invention

The invention relates to face armor for use during law enforcement training and sporting activities, and in particular to face armor for use while training for line-of-sight armed combat or while participating in competitions using non-lethal training ammunition, the face armor including a face guard having closable side slits which accommodate the chin strap of a helmet.

Description of Related Art

Live person-to-person competition using line-of-sight firearms is uniquely effective at training for law enforcement or military operations. Non-lethal training ammunition (NLTA) is frequently used during such training to approximate real life situations as closely as possible. Similarly, paint capsules ("paintballs") are fired during sporting, security, law enforcement and military training activities to mark other participants to indicate a hit. Since both NLTAs and paintballs are fired at substantial velocity against participants, this presents a risk of physical injury, particularly to sensitive areas around the face and neck.

Special protective equipment is usually required during training or sporting activities which use NLTAs or paintballs. An important component of such protective equipment is head armor designed to prevent projectiles from impacting sensitive areas of the face, head and neck. Head armor can include face armor, such as protective goggles and face guards, a helmet, and possibly a neck guard. However, face armor typical in the prior art can be bulky, may not be comfortable to use together with helmets of different sizes and shapes, and may interfere with proper sighting of shoulder weapons.

SUMMARY OF INVENTION

Face armor according to the invention for use during training or sporting activities using NLTAs or paintballs includes a low-profile goggle system and a flexible protective face guard attached to the goggle system to provide impact protection to the face, head, and neck areas, and to prevent various projectiles from reaching the sensitive areas of the front and side areas of the face. The goggle system and face guard are sufficiently flexible to allow a shoulder weapon to be placed in the proper location along the side of a participant's face for sight-picture alignment, but are constructed of material substantial enough to provide impact protection against flying projectiles. The goggle system uses a fused dual lens to prevent fogging. The goggle and the attached protective material are shaped to accommodate interchangeable use with a variety of battle helmets known in the industry.

The face guard is formed to stand off slightly from the face, usually approximately ½" to 1", to allow the skin to breathe and for wearing comfort under strenuous training conditions. The face guard is manufactured of a malleable material that flexes inwardly towards the user's face to form a cheek well when a shoulder weapon is brought to the face to be sighted; when the shoulder weapon is lowered, the face guard returns to its original shape. The flexible nature of the face guard allows trainees to practice shoulder weapon usage under conditions which replicate real life situations as closely as possible, while protecting the head and neck from damage. The face guard material is also designed for easy clean up thereby facilitating use by multiple individuals.

Venting holes in the front and cheek panels of the face guard provide ventilation to the user's face. A permeable mesh is integrated into and across the vent holes to ensure that projectiles cannot pass or push through the vent holes to impact sensitive areas of the face while still allowing the vent holes to provide good ventilation.

The invention facilitates interchangeable use of the face guard with helmets of different sizes and dimensions by providing side slits that can accommodate chin straps of varying widths that extend from different helmets at different angles.

The goggle system includes a detachable brow piece that may be attached to the goggle system as needed.

In one embodiment a port in the brow area of the face armor receives cameras and other electronic training aids.

In another embodiment the face armor includes a flexible neck guard which drops down from the face guard and extends around the chin area and over the neck to provide protection against ammunition entering at unexpected angles such as rear entry projectiles that can ricochet upwardly off the chest area and into a wearer's face under the face guard.

DETAILED DESCRIPTION OF THE ILLUSTRATED EMBODIMENT

Figure 1A:
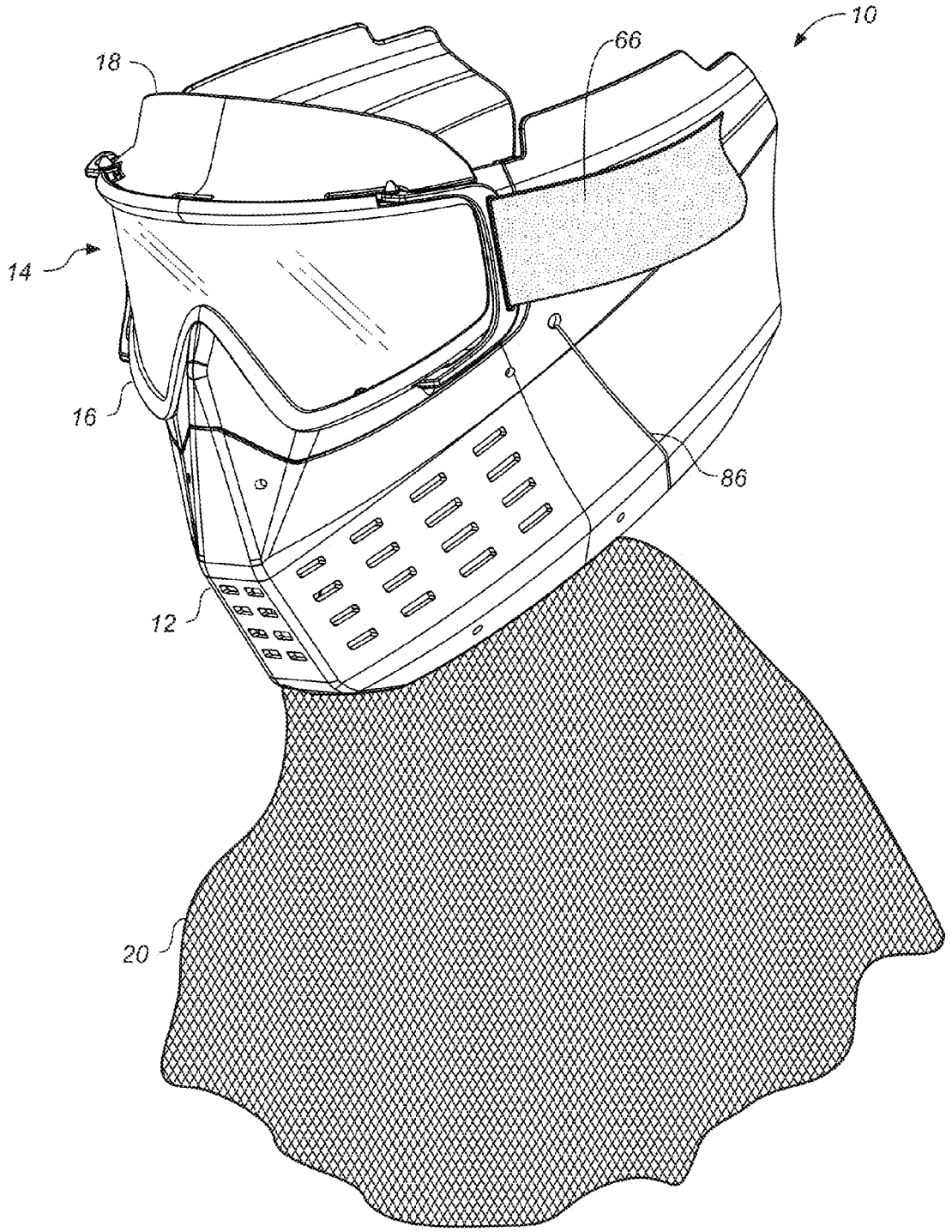
FIG. 1A is an upper perspective view of face armor according to the invention.
Figure 2A:
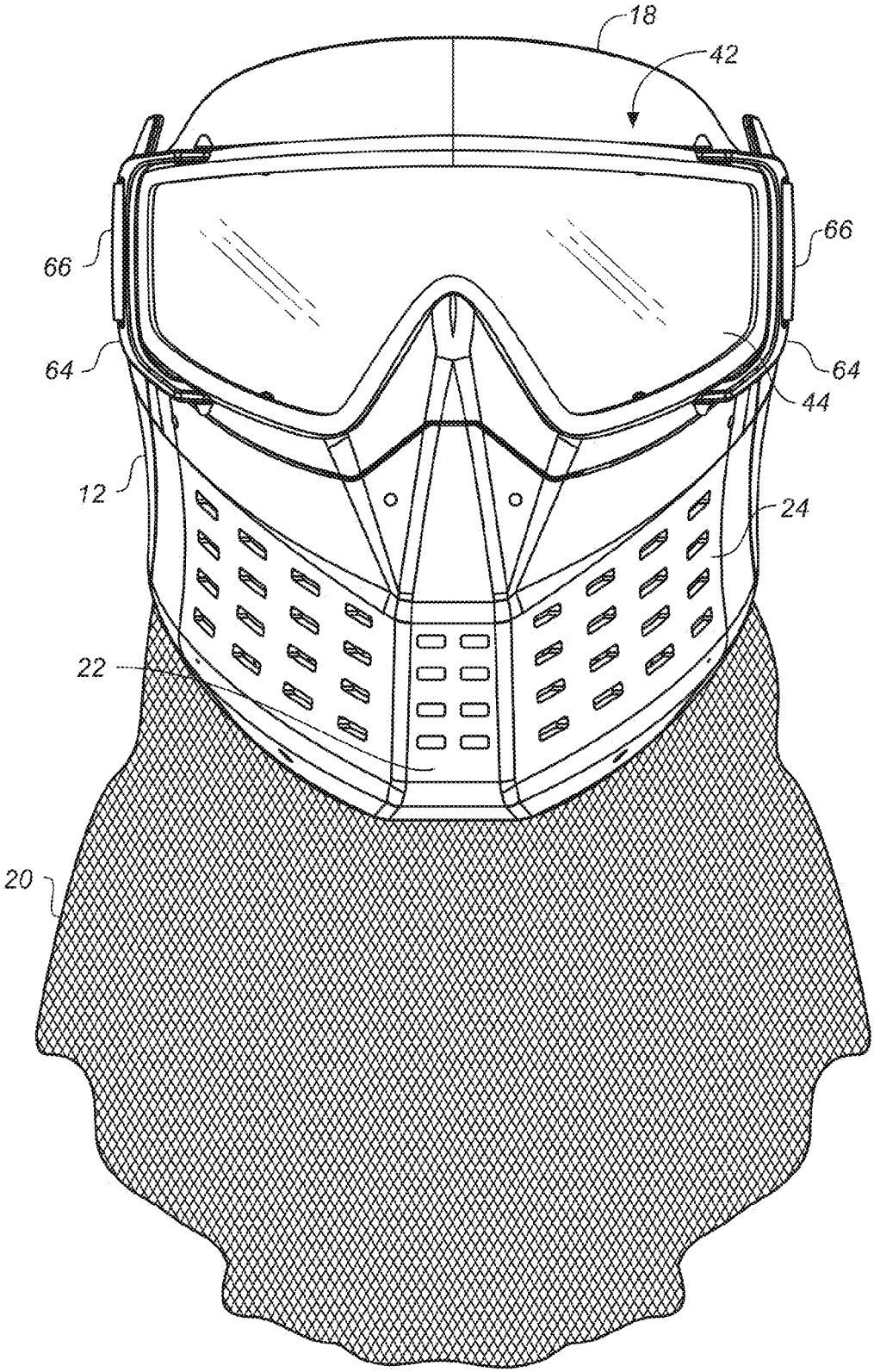
FIG. 2A is a front elevation view of the face armor of FIG. 1.
Figure 2B:
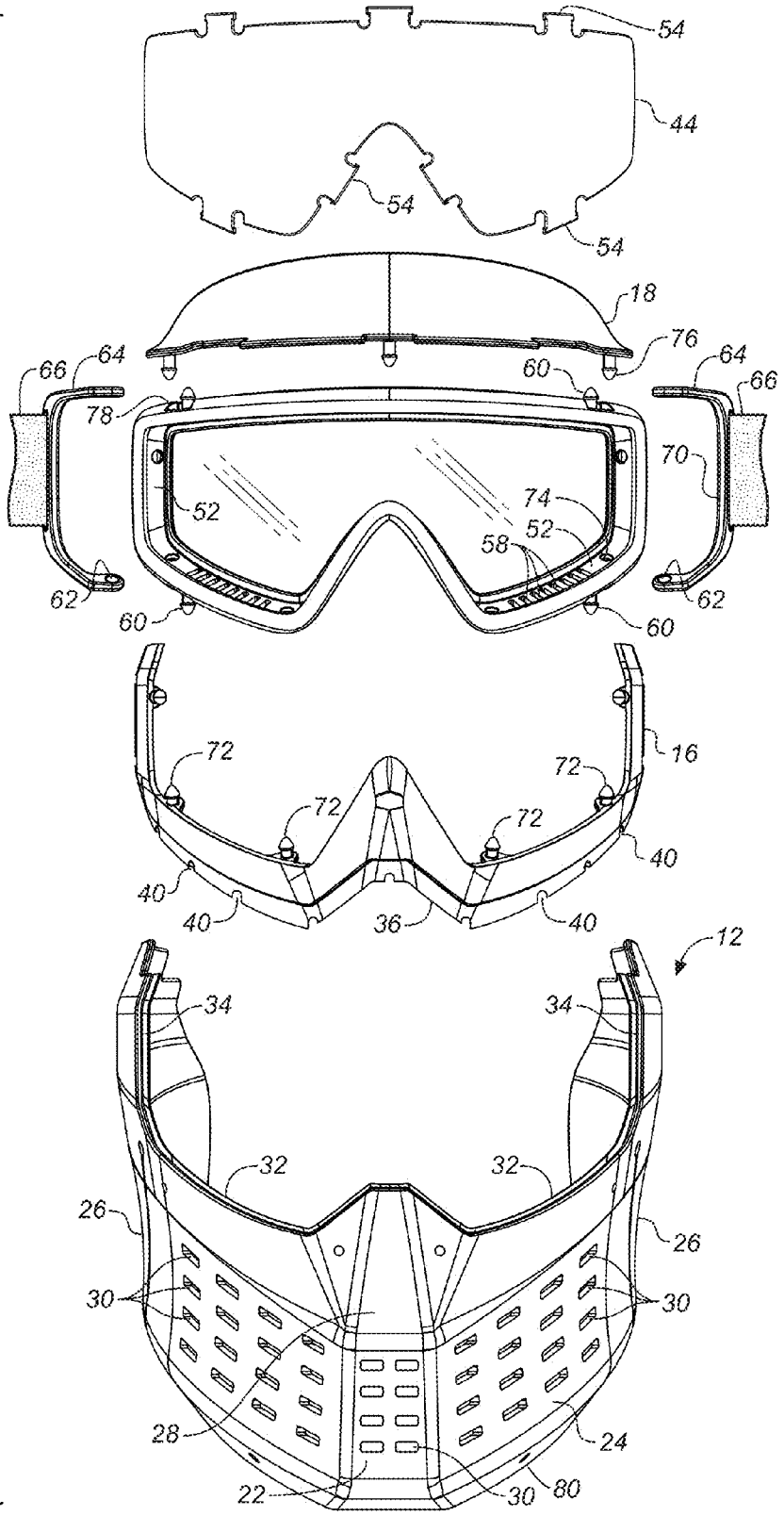
FIG. 2B is an exploded front elevation view of the elements of the face armor shown in FIG. 2A.
Figure 3A:
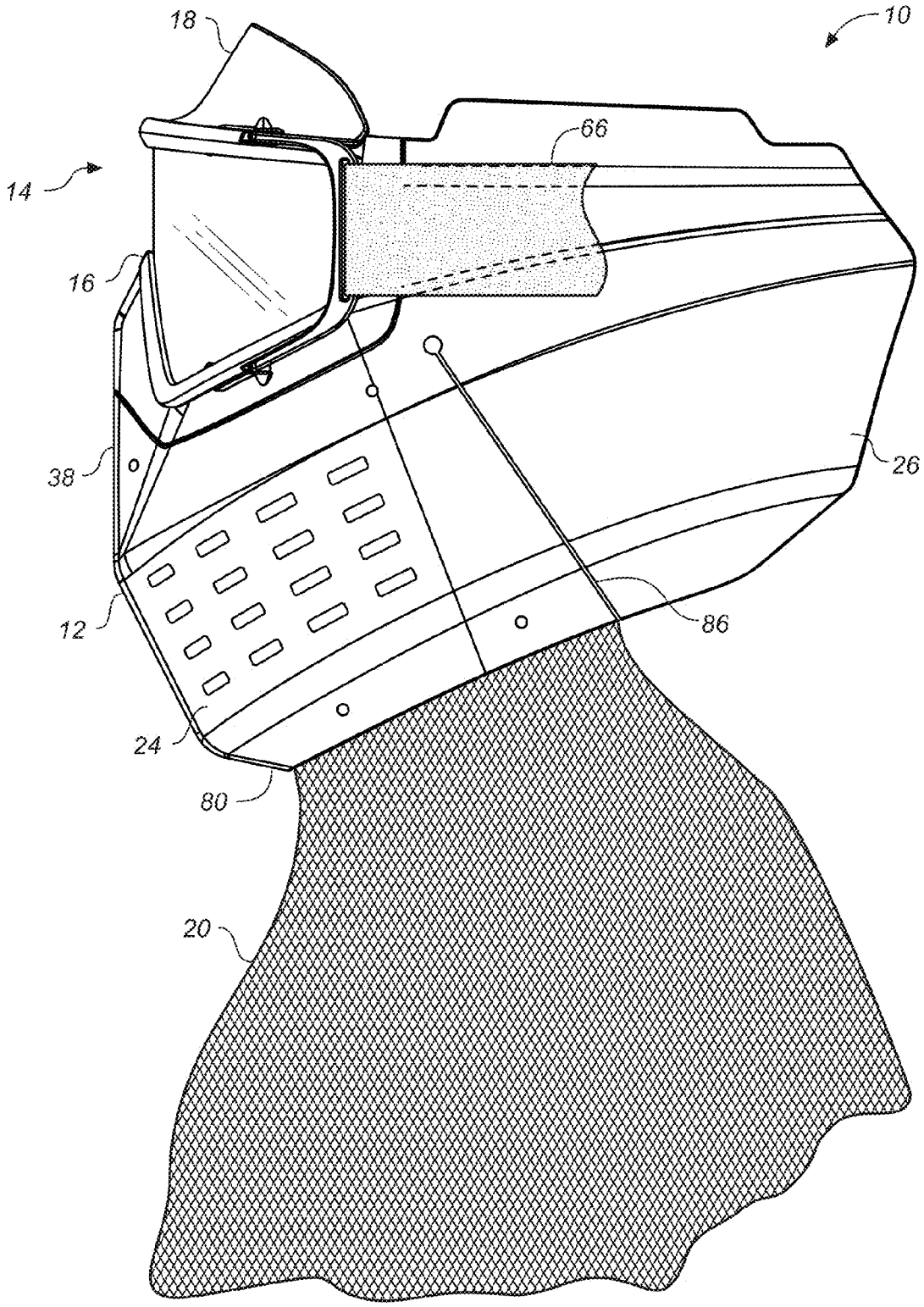
FIG. 3A is a side elevation view of the face armor of FIG. 1.
Figure 3B:
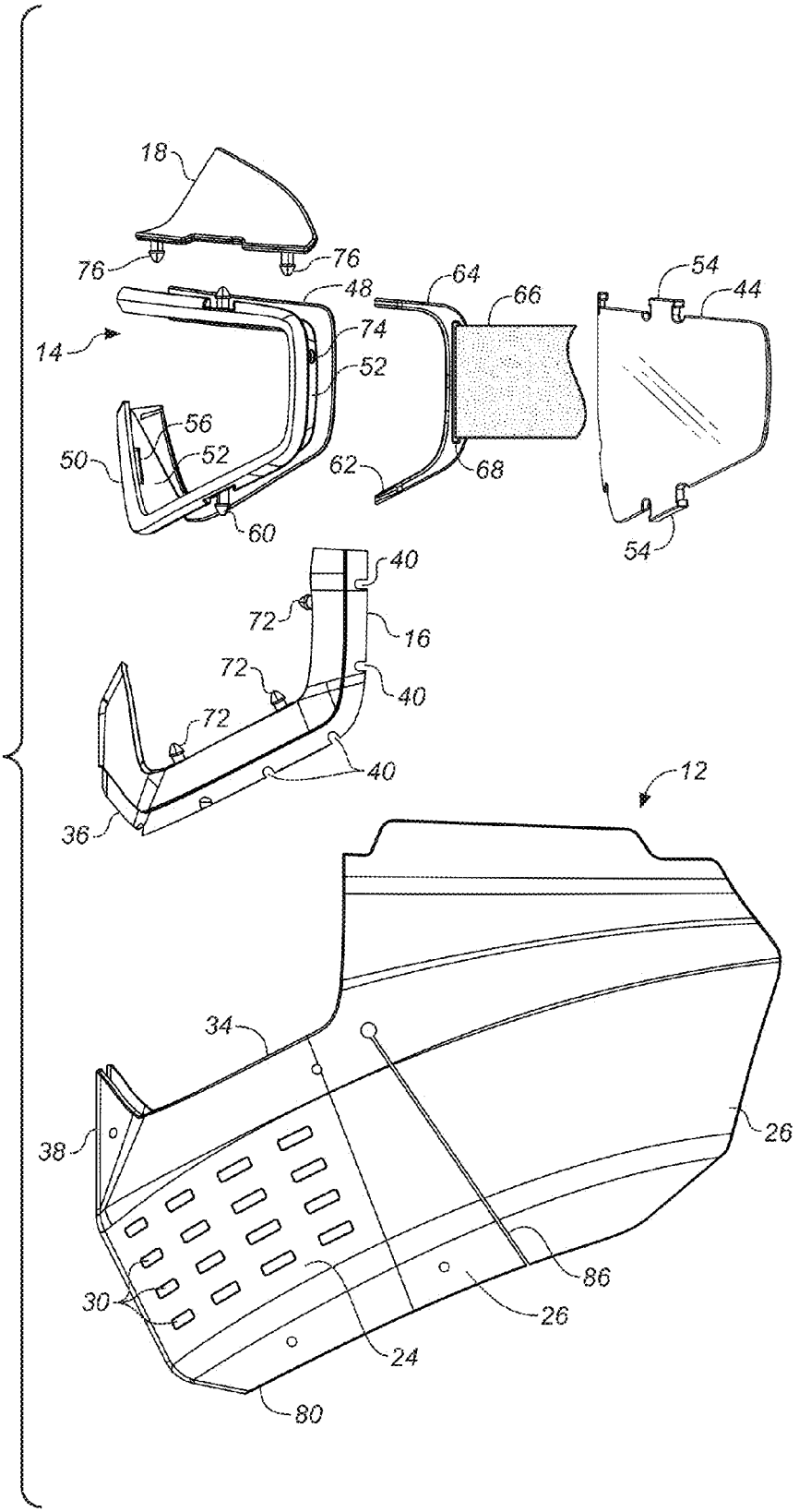
FIG. 3B is an exploded side elevation view of the elements of the face armor shown in FIG. 3A.

Face armor according to the invention is generally indicated at element number 10 in FIGS. 1A, 2A and 3A of the accompanying drawings. With additional reference to FIGS.

Figure 1B:
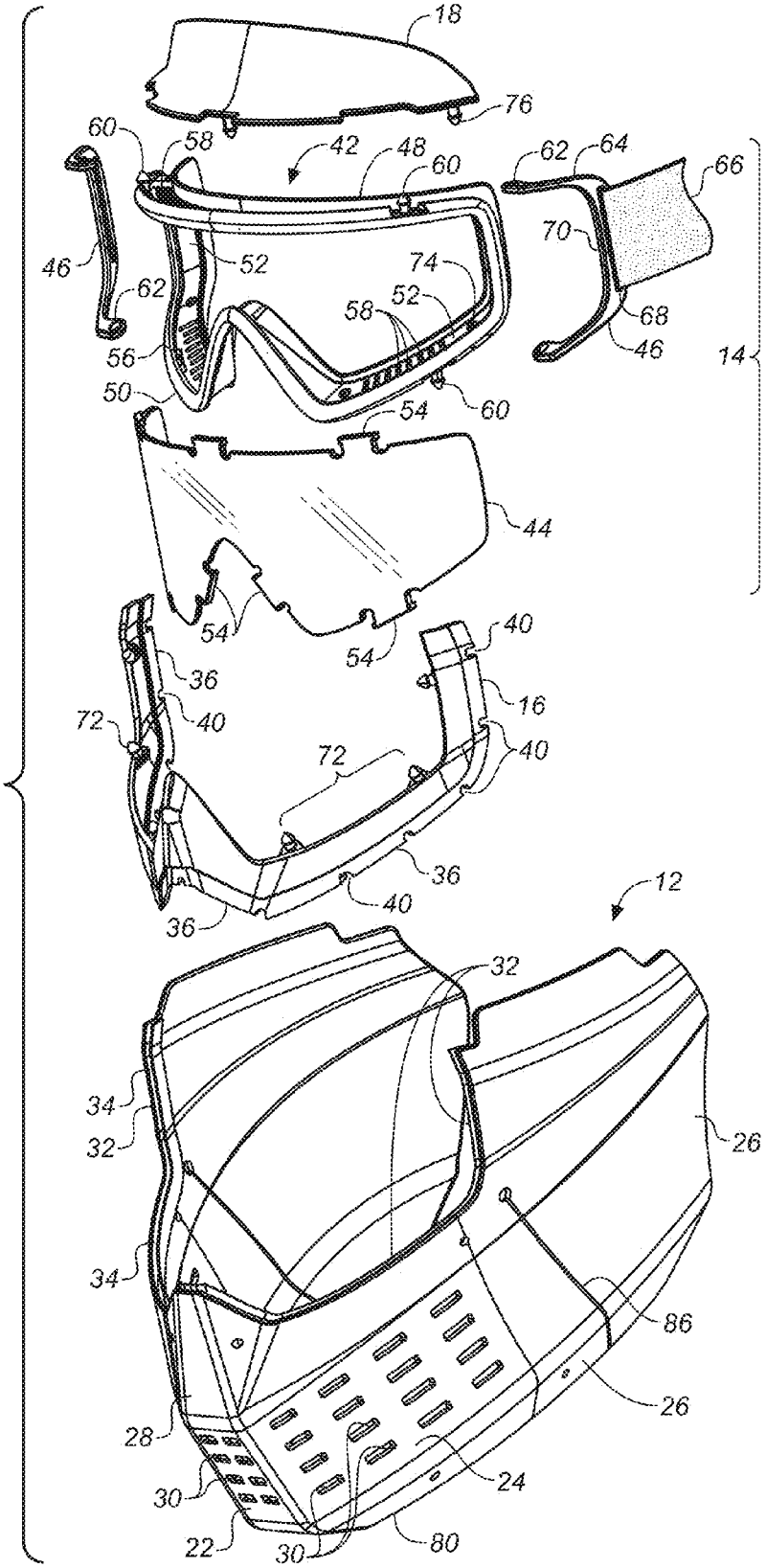
FIG. 1B is an exploded upper perspective view of the elements of the face armor shown in FIG. 1.

1B, 2B and 3B, face armor 10 comprises a face guard 12, goggle assembly 14 (see FIG. 1B), connector flange 16, brow piece 18, and neck guard 20 (see FIGS. 1A, 2A and 3A).

Figure 7:
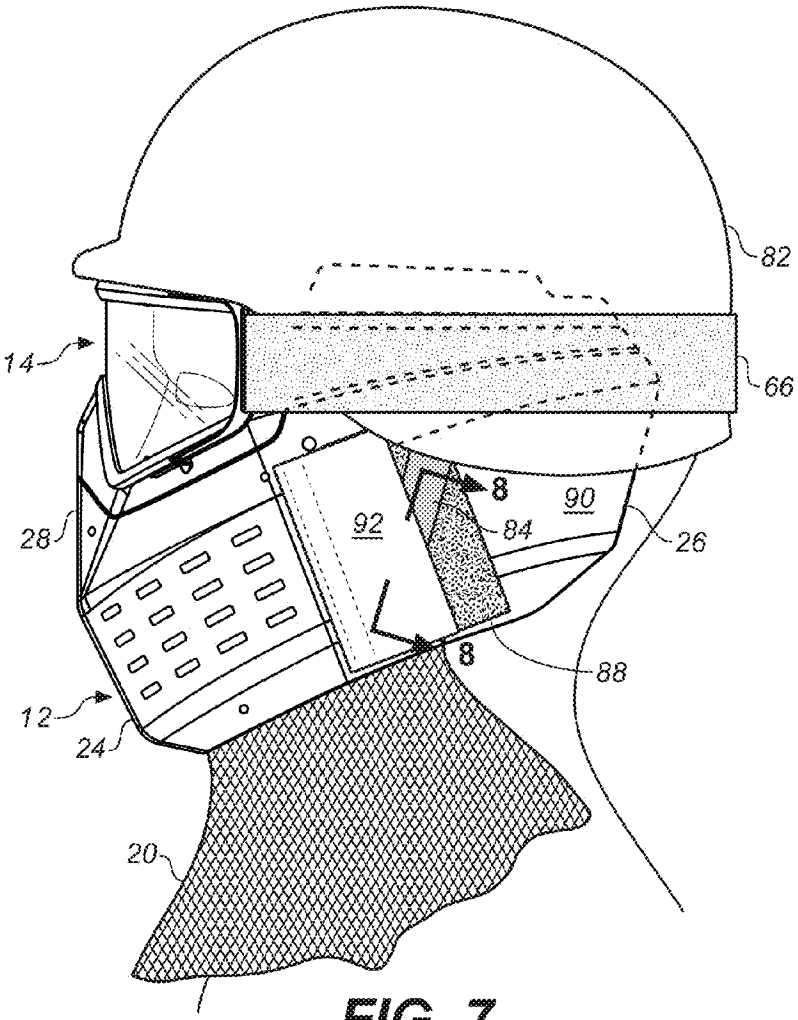
FIG. 7 is a side elevation view similar to FIG. 6 showing a fastener closed over the chin strap and side slit and also showing the neck guard.
Figure 6:
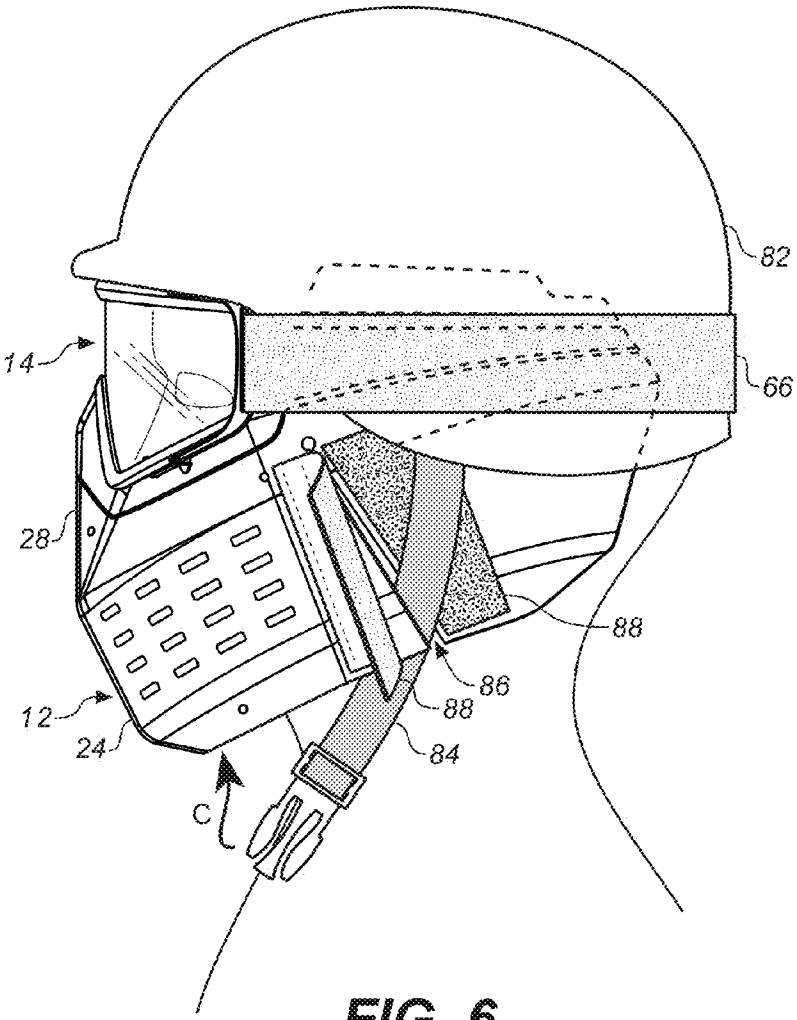
FIG. 6 is a side elevation view showing the face armor and helmet of FIG. 5 being worn on a person's head with the helmet's chin strap unbuckled and extending through the side slit of the face guard of the face armor.
Figure 9:
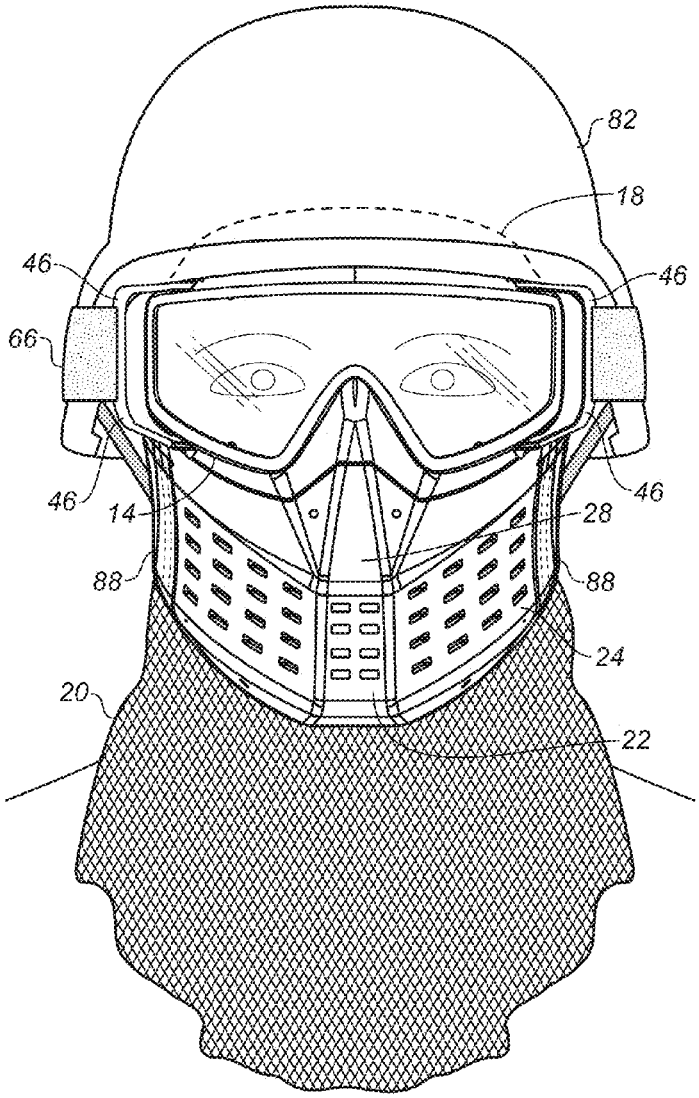
FIG. 9 is a front elevation view of the face armor and the helmet shown in FIG. 7.

The face guard 12 includes front panel 22, cheek panels 24, side panels 26 and nose guard 28. FIGS. 6, 7 and 9 show the face guard 12, connector flange 16, goggle assembly 14, and neck guard being worn by an individual simultaneously with a protective helmet 82. It is seen that the neck guard 20 and the front and cheek panels 22, 24 of the face guard 12 fit over and protect the user's neck, mouth, cheek and chin areas. Arrays of ventilation holes 30 in the front panel 22 and cheek panels 24 permit air to circulate between the panels 22, 24 and the user's face. Side panels 26 protect parts of the face and head rearward of the cheeks, and the nose guard 28 fits over and protects the nose.

The upper edges of the nose guard 28 and the cheek panels 24 and the inner edge of the side panels 26 collectively form an upper attachment edge 32 for attaching the connector flange 16 to the face guard 12. A continuous channel 34 formed in the attachment edge 32 conforms to the shape of and receives the connector flange's lower edge 36. Semi-circular indents 40 spaced along the lower edge 36 cooperatively engage with positioning bosses (not shown) distributed along the bottom of channel 34 to aid in correctly positioning the connector flange 16 on the face guard 12.

The goggle assembly 14 is comprised of goggle frame 42, dual lens 44, and strap hinges 46. The goggle frame 42 has an inner mounting flange 48, a forward rim 50 and a spacing flange 52 extending between and joining inner mounting flange 48 and forward rim 50. Spacing flange 52 spaces forward rim 50 forward of inner mounting flange 48. The forward rim 50 is in this manner spaced away from the face of a wearer when the goggle system is being worn, as shown in FIGS. 6, 7 and 9, since the inner mounting flange 48 is resting directly against the wearer's face. The lens 44 is a gas-filled anti-fogging dual lens of a type widely used in the goggle industry. Lens 44 is attached to goggle frame 42 by inserting it between inner mounting flange 48 and forward rim 50 and extending top and bottom positioning tabs 54 through top and bottom slots 56 in the spacing flange 52 immediately rearward of forward rim 50. The lens is thus spaced away from the user's face when the goggles are being worn. Ventilation apertures 58 provided in spacing flange 52 allow air to circulate between the wearer's face and lens 44.

Strap hinges 46 are pivotally attached to goggle frame 42 by inserting pivot pins 60 on the top and bottom edges thereof through apertures 62 of the pivot arms 64 of the strap hinges. A head strap 66 is inserted through the strap openings 68 in the hinge body 70 for securing the goggle assembly around a user's head. The strap hinges 46 may thus swing outwardly from the goggle frame 42 to adjust for helmets of varying dimensions that may be worn with the face armor. See FIGS. 1A and 9.

The goggle assembly 14 is attached to the connector flange 16, and hence to face guard 12, by inserting a plurality of barbed fastening pegs 72 along the top edge of the connector flange 16 into receiving holes 74 in the bottom and sides of the spacing flange 52 of goggle frame 46. The brow piece 18 may optionally be attached to the top of the goggle frame by inserting brow attachment spikes 76 into brow spike receiving holes 78 in the top of the goggle frame 46.

With reference to FIGS. 1A, 2A and 3A, the neck guard 20 may be attached to and project below the bottom edge 80 of the face guard 12 to protect sensitive areas of the neck from projectiles.

Figure 4:
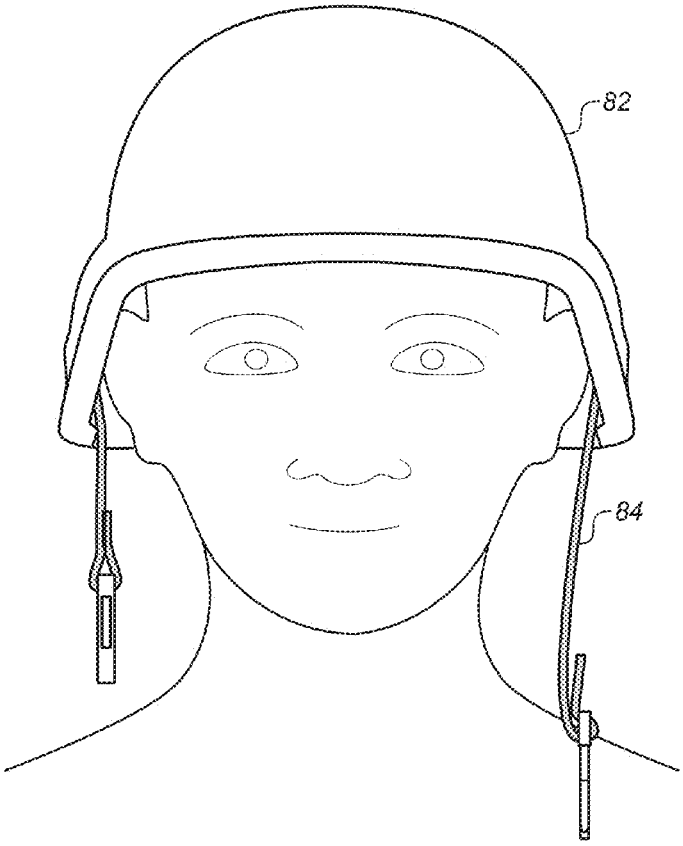
FIG. 4 is a front elevation view of a conventional battle helmet shown as typically worn on a person's head.
Figure 5:
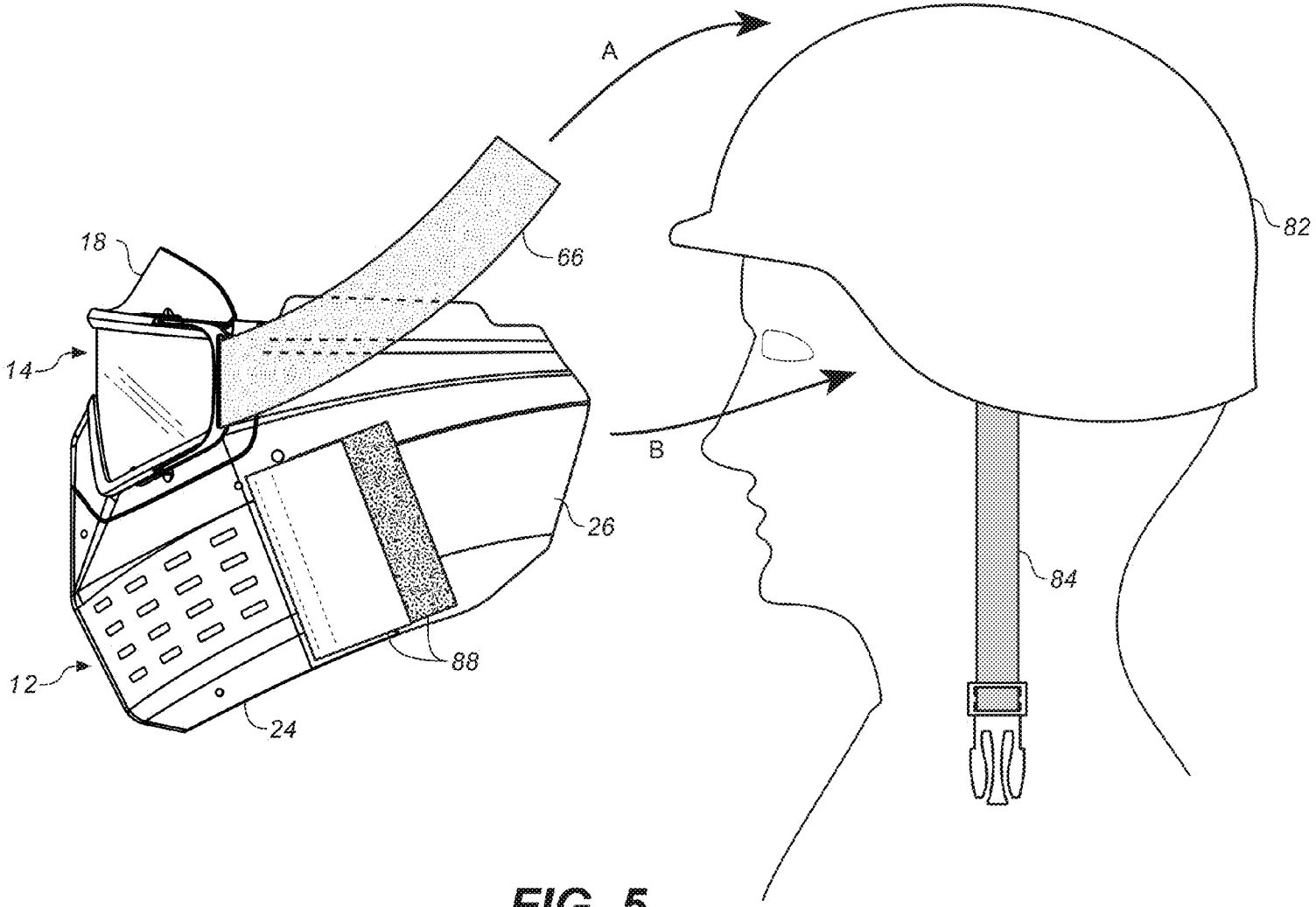
FIG. 5 is an exploded side elevation view of the helmet shown in FIG. 4 and of the face armor, the neck guard being omitted, shown in FIG. 1.
Figure 8:
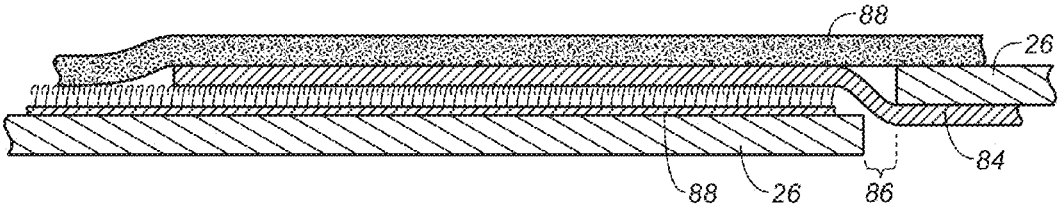
FIG. 8 is a close-up sectional view of the side slit, chin strap and fastener on the side of the face guard taken along lines 8-8 of FIG. 7.

FIG. 4 shows a typical battle or training helmet 82 as usually worn on a person's head. FIG. 5 shows face guard 12 and a goggle system 14 poised in front of a person wearing a helmet 82 as in preparation for placement over the person's face as indicated by arrows A and B. The face guard 12 and goggle system 14 are donned by bringing the goggle assembly 14 over and around the eyes. This positions the front and cheek panels 22, 24 and nose guard 28 of the face guard over the cheeks, chin and nose. The side panels 26 are brought rearward along the side of the face and head; the upper part of the side panels 26 must be tucked under the helmet 82 as shown in FIGS. 6 and 7, and the helmet's chin strap 84 maneuvered into the side slit 86 provided in each side panel 26, as shown in FIG. 6. The chin strap 84 is then maneuvered around and buckled under or around the chin as indicated by arrow C. In one aspect of the invention, the face guard 12 is flexible enough to be bent upwards enough to buckle the chin strap around the wearer's chin. Once the chin strap 84 is secured around the wearer's chin, the slit 86 may be securely closed using a hook-and-look type fastener 88 straddling the slit. Those of skill in the art will appreciate that, while the illustrated embodiment shows a hook-and-loop type fastener, other fasteners may be employed such as snaps or hooks which may readily be opened or closed manually. As seen in FIGS. 7 and 8 the fastener 88 also closes over the chin strap 84 which further secures it in position in slit 86. In this configuration the helmet's chin strap 88 extends from the helmet over the outer surface 90 of the rearward portion of the side panel 26, through the side slit 86, thence under the forward portion 92 of the side panel 26 and underneath the cheek and front panels 24, 22 to and around the wearer's chin. The goggle strap 66 is then pulled over and fastened around the helmet 82, as shown in FIG. 7. Finally, the neck guard 20 may be deployed. See FIGS. 7 and 9. The side slit makes it possible to comfortably wear face armor and a battle helmet together since the chin strap of the helmet can now extend directly from the helmet to the wearer's chin without undue interference and displacement from the face guard, so that the chin strap fits snugly and comfortably along the side of the wearer's head.

The side slots 84 are of a sufficient length that chin straps 84 of different sizes or which extend at different angles from a helmet 82 may all be accommodated. This enables both the face armor 10 and a selected one of multiple head helmets 82 to be worn comfortably and securely on a user's face and head.

A reinforcing mesh (not shown) is incorporated into the material of the face guard 12 in and around the ventilation holes 30 in the front and cheek panels 22, 24. The mesh is suitably porous to permit breathing through the face guard 12, but strong enough to prevent the ventilation holes 30 from stretching upon impact from an NLTA, such that NLTAs cannot penetrate the face guard 12 through one of the ventilation holes 30.

As mentioned above, the brow piece 18 may be optionally attached to the goggle assembly 14 as desired. The brow piece 18 may be used most advantageously if a helmet 82 is not being used during a training exercise. The brow piece 18 provides added protection against projectiles entering the sensitive eye region from above the goggles.

The neck guard 20 may be attached to the face guard using snaps, hook-and-look type fasteners, or other fastening means. In one embodiment, the neck guard 20 is an extension of the mesh material that is used to reinforce the ventilation holes 30 in the face guard 12 as discussed above.

With reference again to FIGS. 1A, 2A and 3A, in one embodiment of the invention, the face guard is constructed of a polymer that is flexible, but sufficiently tough to resist penetration by NTLAs experienced during typical training exercises. The cheek panels 24 will bow inwardly when an object such as a shoulder weapon is brought to the wearer's cheek, but will return to their original stand-off configuration, in which the cheek panels cover but are spaced from the wearer's cheeks, when the object is removed. This enables formation of an on-demand cheek well which assists proper sighting when using a shoulder weapon or other line-of-sight instrument, thus more faithfully replicating real-world conditions for improved training exercises.

When face armor 10 is worn with a helmet 82, the combination provides impact protection to the face, head, and neck areas against flying projectiles. When being worn, only a small portion of the face armor is in contact with the wearer's skin, most of the face armor being formed to stand off slightly from the face allowing a comfortable fit and enabling the skin to breathe. The polymer construction enables an on-demand cheek well to be formed when an object is brought against the side panels and pressed towards the cheek for improved use of line-of-sight instruments, as well as easy cleanup for repeated use by multiple individuals.

There have thus been described and illustrated certain embodiments of face armor according to the invention. Although the present invention has been described and illustrated in detail, it should be clearly understood that the disclosure is illustrative only and is not to be taken as limiting, the spirit and scope of the invention being limited only by the terms of the appended claims and their legal equivalents.

What is claimed is:

1. Face armor for wearing with a helmet, the helmet having a chin strap configured to extend to the chin of a person wearing the helmet, the face armor comprising:

a face guard having dual side panels for disposition on opposite sides of the head of a person wearing the face guard, each of said side panels having a bottom edge, a side slit extending upwardly from said bottom edge, a rearward portion extending rearward of said side slit, and a forward portion extending forward of said side slit, and a fastener which closes over said side slit to secure said forward and rearward portions together, said rearward portion having an outer surface, and said forward portion having an inner surface, wherein the chin strap of a helmet being worn by the person extends over the rearward portion of said side panel, passes through said side slit, and extends from said side slit under said forward portion to the person's chin so that any interference from the face guard to snug fitting of the helmet's tightened chin strap along the side of the person's head is minimized.

2. The face armor of claim 1 wherein:

said fastener covers a portion of the chin strap extending over the rearward portion of said side panel.

3. The face armor of claim 1 further comprising:

said face guard having a forward panel and dual cheek panels, said cheek panels extending between said forward panel and said side panels, said cheek panels for covering the cheeks of a person wearing the face guard, said cheek panels having a stand-off configuration in which said cheek panels cover but are spaced from the person's cheeks, each cheek panel sufficiently flexible that it bows inwardly to form a cheek well when an object being brought toward the cheek of a person wearing the face guard bears inwardly against said cheek panel, wherein said cheek panel returns to said stand-off configuration when the object is removed.

4. The face armor of claim 1 further comprising:

said face guard having a forward panel and dual cheek panels, said forward panel for covering the front of the face of a person wearing the face guard, said cheek panels for covering the cheeks of the person wearing the face guard, said cheek panels extending between said forward panel and said side panels, said forward and cheek panels configured to be spaced from the face of the person wearing the face guard, and said forward and cheek panels having an array of apertures providing ventilation between the forward and cheek panels and the person's face.

5. The face armor of claim 1 further comprising:

a goggle system for protecting the eyes of a person wearing the face guard, and a connector flange having a lower edge, said connector flange extending between and attaching said forward and cheek panels to said goggle system.

6. The face armor of claim 1 wherein:

said face guard comprises a flexible polymer.

7. Face armor for wearing with a helmet, the helmet having a chin strap configured to extend to the chin of a person wearing the helmet, the face armor comprising:

a face guard having dual side panels for disposition on opposite sides of the head of a person wearing the face guard, each of said side panels having a bottom edge, a side slit extending upwardly from said bottom edge, a rearward portion extending rearward of said side slit, a forward portion extending forward of said side slit, and a fastener which closes over said side slit and extends over the rearward portion of said side panel, said rearward portion having an outer surface, and said forward portion having an inner surface, wherein the chin strap of a helmet being worn by the person extends over the rearward portion of each said side panel, passes through said side slit, and is configured to extend from said side slit under said forward portion to the person's chin so that any interference from the face guard to snug fitting of the helmet's tightened chin strap along the side of the person's head is minimized, and the fastener when closed over said side slit covers a portion of the chin strap adjacent said side slit thereby securing the chin strap in position in said side slit.

8. Face armor for wearing with a helmet, the helmet having a chin strap configured to extend to the chin of a person wearing the helmet, the face armor comprising:

a face guard having a forward panel, dual side panels and dual cheek panels, said forward panel for covering the front of the face of a person wearing the face guard, said cheek panels extending between said forward panel and said side panels for covering the cheeks of the person wearing the face guard, said dual side panels for disposition on opposite sides of the head of a person wearing the face guard, said forward and cheek panels configured to be spaced from the face of the person wearing the face guard, and said forward and cheek panels having an array of apertures providing ventilation between the forward and cheek panels and the person's face, each of said side panels having a bottom edge, a side slit extending upwardly from said bottom edge, a rearward portion extending rearward of said side slit, a forward portion extending forward of said side slit, and a fastener which closes over said side slit and extends over the rearward portion of said side panel, said rearward portion having an outer surface, and said forward portion having an inner surface, wherein the chin strap of a helmet being worn by the person extends over the rearward portion of each said side panel, passes through said side slit, and extends from said side slit under said forward portion to the person's chin so that any interference from the face guard to snug fitting of the helmet's tightened chin strap along the side of the person's head is minimized, and the fastener when closed over said side slit covers a portion of the chin strap adjacent said side slit thereby securing the chin strap in position in said side slit.

9. Face armor for wearing with a helmet, the helmet having a chin strap configured for extending to the chin of a person wearing the helmet, the face armor comprising:

a face guard having dual side panels for disposition on opposite sides of the head of a person wearing the face armor, each of the side panels having a bottom edge, a side slit extending upwardly from the bottom edge, a rearward portion extending rearward of the side slit, and a forward portion extending forward of the side slit, the rearward portion having an outer surface, and the forward portion having an inner surface, wherein the chin strap of a helmet being worn by the person wearing the face armor extends over the rearward portion of the side panel, passes through the side slit, and extends from the side slit under the forward portion to the person's chin so that any interference from the face guard to snug fitting of the helmet's tightened chin strap along the side of the person's head is minimized, the face guard having a forward panel and dual cheek panels, the cheek panels extending between the forward panel and the side panels, the cheek panels configured for covering the cheeks of a person wearing the face armor, the cheek panels having a stand-off configuration in which the cheek panels cover but are spaced from the person's cheeks, each cheek panel being sufficiently flexible and suitably sized such that, when a line-of-sight instrument or a hand holding the line-of-sight instrument is pressed inwardly there against, the cheek panel bows inwardly to form a cheek well of sufficient depth to enable the line-of-sight instrument to be sighted by the person wearing the face armor and, when the line-of-sight instrument or the hand holding the line-of-sight instrument is removed from the cheek panel, the cheek panel returns to the stand-off configuration.

10. The face armor of claim 9 wherein:

the side panels are formed substantially free of apertures, but the cheek panels each include an array of spaced apart apertures distributed substantially there across, the array of apertures sufficiently sized to provide ventilation for a person wearing the face armor.

11. A method for sighting a line-of-sight instrument while wearing face armor, the method comprising:

positioning a line-of-sight instrument or a hand holding the line-of-sight instrument against one of a pair of cheek panels of a face guard being worn by a person, the face guard configured for covering the face of a person, the cheek panels configured for covering the cheeks of the person in a stand-off configuration in which the cheek panels are spaced from the person's cheeks, the face guard including dual side panels and a forward panel, said dual side panel for disposition on opposite sides of the head of a person wearing the face guard, each of the side panels having a bottom edge, a side slit extending upwardly from the bottom edge, a rearward portion extending rearward of the side slit, and a forward portion extending forward of the side slit, the rearward portion having an outer surface, and the forward portion having an inner surface, the dual cheek panels extending between the forward panel and the side panels, pressing the line-of-sight instrument or the hand holding the line-of-sight instrument inwardly against the cheek panel such that the cheek panel bows inwardly to form a cheek well of sufficient depth to enable the line-of-sight instrument to be sighted by the person, and removing the instrument from the cheek panel such that the cheek panel returns to the stand-off configuration.

* * * * *